US008727836B2

(12) United States Patent
Smith et al.

(10) Patent No.: US 8,727,836 B2
(45) Date of Patent: May 20, 2014

(54) ELECTRIC ABRASIVE SHARPENER HAVING ADJUSTABLE ABRASIVE WHEELS

(75) Inventors: Richard S. Smith, Hot Springs, AR (US); Louis Chalfant, Hot Springs, AR (US)

(73) Assignee: Smith's Consumer Products, Inc., Hot Springs, AR (US)

( * ) Notice: Subject to any disclaimer, the term of this patent is extended or adjusted under 35 U.S.C. 154(b) by 637 days.

(21) Appl. No.: 13/066,009

(22) Filed: Apr. 4, 2011

(65) Prior Publication Data

US 2011/0244766 A1 Oct. 6, 2011

Related U.S. Application Data

(60) Provisional application No. 61/341,711, filed on Apr. 5, 2010.

(51) Int. Cl.
*B24B 7/00* (2006.01)

(52) U.S. Cl.
USPC ..... 451/192; 451/194; 451/349

(58) Field of Classification Search
USPC ..... 451/45, 192, 194, 196, 241, 349
See application file for complete search history.

(56) References Cited

U.S. PATENT DOCUMENTS

| | | | |
|---|---|---|---|
| 2,617,235 | A | 11/1952 | Lindahl |
| 2,765,680 | A | 10/1956 | Murchison |
| 3,758,993 | A | 9/1973 | Kirtz |
| 3,811,226 | A | 5/1974 | Gangelhoff et al. |
| 4,520,540 | A | 6/1985 | Killop |
| 5,810,646 | A | 9/1998 | Hepworth |
| 5,906,534 | A | 5/1999 | Folkman et al. |
| 6,071,181 | A | 6/2000 | Wightman et al. |
| 6,368,196 | B1 | 4/2002 | Bauer |
| 6,709,320 | B2 | 3/2004 | Li |

FOREIGN PATENT DOCUMENTS

| | | |
|---|---|---|
| FR | 1 058 574 | 3/1954 |
| FR | 2 558 094 | 7/1985 |
| GB | 961 090 | 6/1964 |

*Primary Examiner* — Eileen P. Morgan
(74) *Attorney, Agent, or Firm* — Edward D. Gilhooly

(57) ABSTRACT

An electric sharpener having two pairs of interlocking abrasives for sharpening the edge of blades to different sharpening angles. An adjustment assembly simultaneously moves the wheels of each pair either toward or away from each other to adjust the sharpening angle produced by pair of abrasive wheels in a sharpening operation. The adjustment assembly is provided with a rotatable shaft having an external handle which engages a lower platen. The lower end of the shaft is threaded to move the platen in vertical direction to move translation bars affixed to the platen. The translation bars extend through elongated slots in respective pairs of adjustment arms coupled to each pair of abrasive wheels to rotate and vary the spacing between the abrasive wheels and adjust sharpening angles.

10 Claims, 12 Drawing Sheets

ELECTRIC ABRASIVE SHARPENER HAVING ADJUSTABLE ABRASIVE WHEELS

This application claims priority to U.S. provisional application Ser. No. 61/341,711 filed Apr. 5, 2010.

BACKGROUND OF THE INVENTION

1. Field of the Invention

This invention relates to abrasive sharpeners, and more particularly, to an electric abrasive sharpener having adjustable counter-rotating abrasive wheels.

2. Summary of the Prior Art

Numerous self-powered, electric abrasive sharpeners have been developed in the past. Although some past designs produce satisfactory results, the self-powered systems in the prior art are relatively expensive and must rely on the use of heavy duty electric motors for attaining adequate torque to satisfactorily drive the abrasive wheels. One convenient and advantageous feature not found in known sharpeners is to provide an economical and effective technique in adjusting the sharpening angle of the grinding wheels. Such an option allows different sized blades to be effectively sharpened. Further, in the past it has been difficult to adjust two set of grinding assemblies in manner to easily and economically to apply two angles on the edge of a blade, which is desirable.

SUMMARY OF THE INVENTION

It is therefore an objective of the invention to provide an improved electric sharpener for knives, scissors, and other implements having an adjustment assembly for adjusting the sharpening angles of counter rotating abrasive wheels and to effectively sharpen the edges of blades having different sizes. The adjustment assembly permits the user to manually adjust the sharpening angles over a large range from 0 to 90°. The adjustment assembly of the invention is intended to be mechanically coupled to an exterior adjustment knob. The adjustment assembly transmits forces to vary the sharpening angle of the grinding wheels by moving them toward and away from each other as desired. In use of two pairs if interlocking grinding wheels, the adjustment assembly of the invention is capable of simultaneously adjusting the two separate pairs of wheels in a manner that two different sharpening angles can be provided at the same time.

DESCRIPTION OF THE PREFERRED EMBODIMENT

Figure 1:
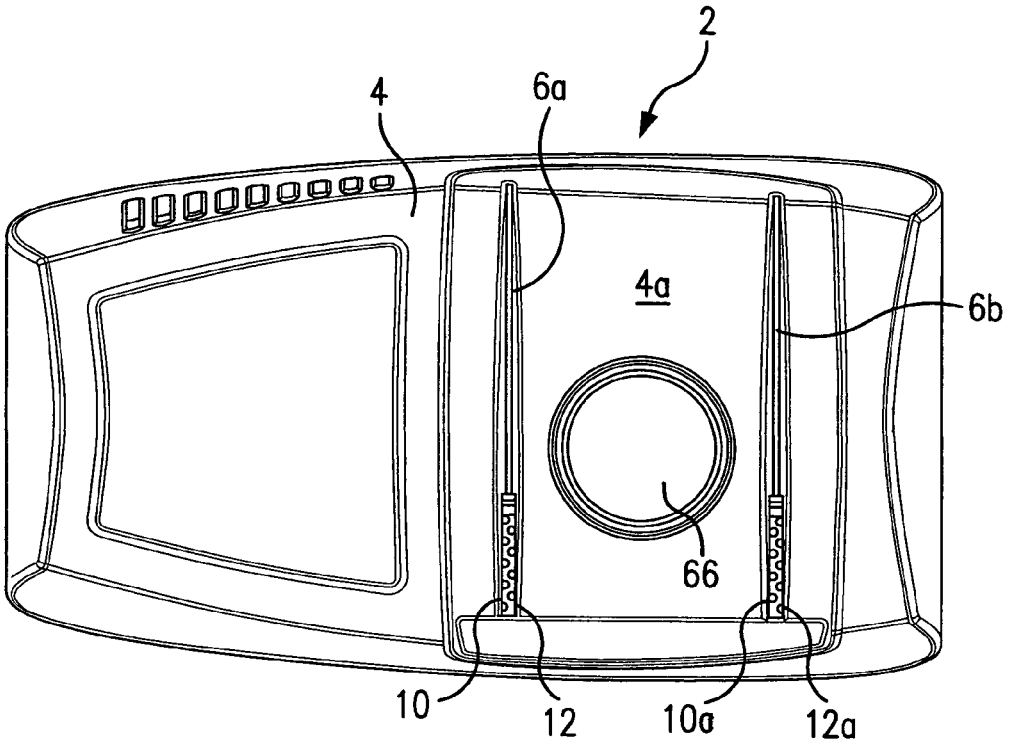
FIG. 1 is a top plan view of the electric sharpener having adjustable abrasive wheels of the invention.
Figure 2:
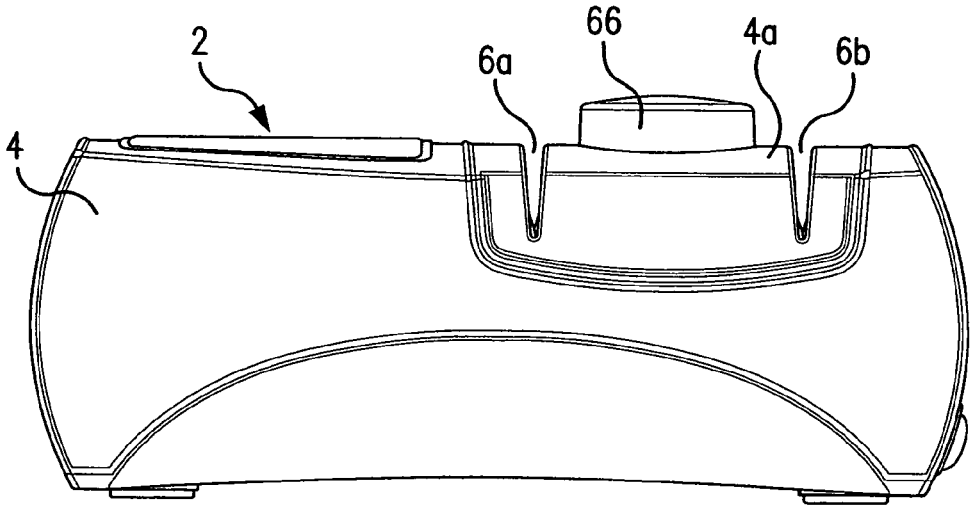
FIG. 2 is a front perspective view of the electric sharpener of FIG. 1.
Figure 3:
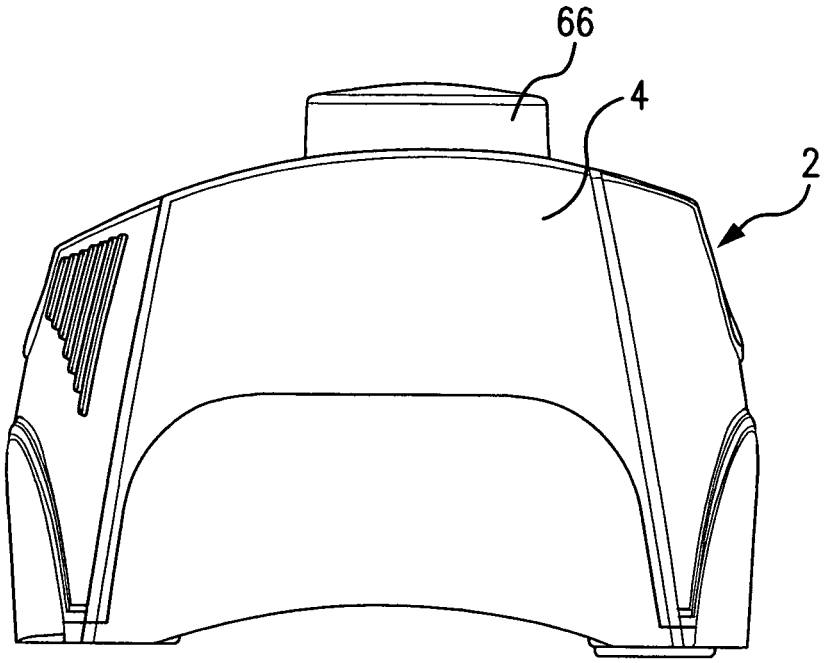
FIG. 3 is a left side elevational view of the electric abrasive sharpener of FIG. 1.
Figure 4:
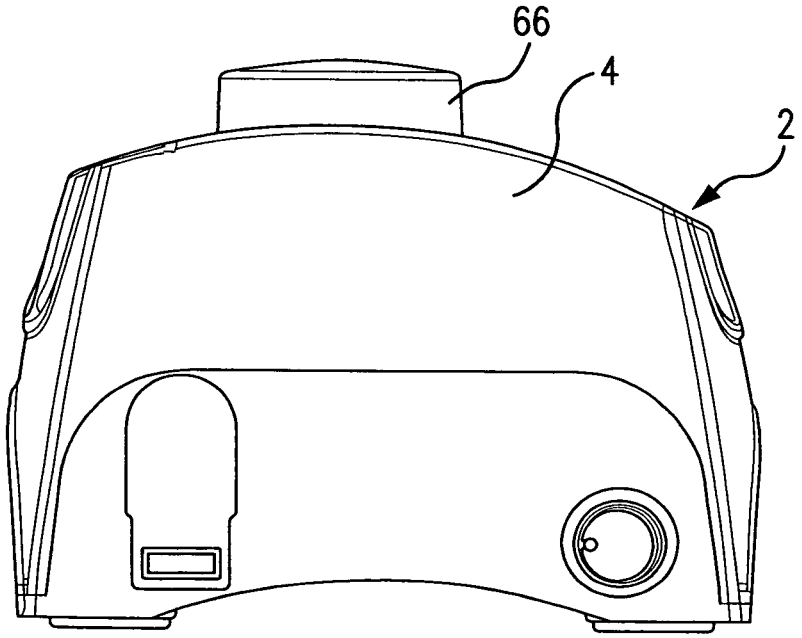
FIG. 4 is a right side elevational view of the electric abrasive sharpener of FIG. 1.
Figure 5:
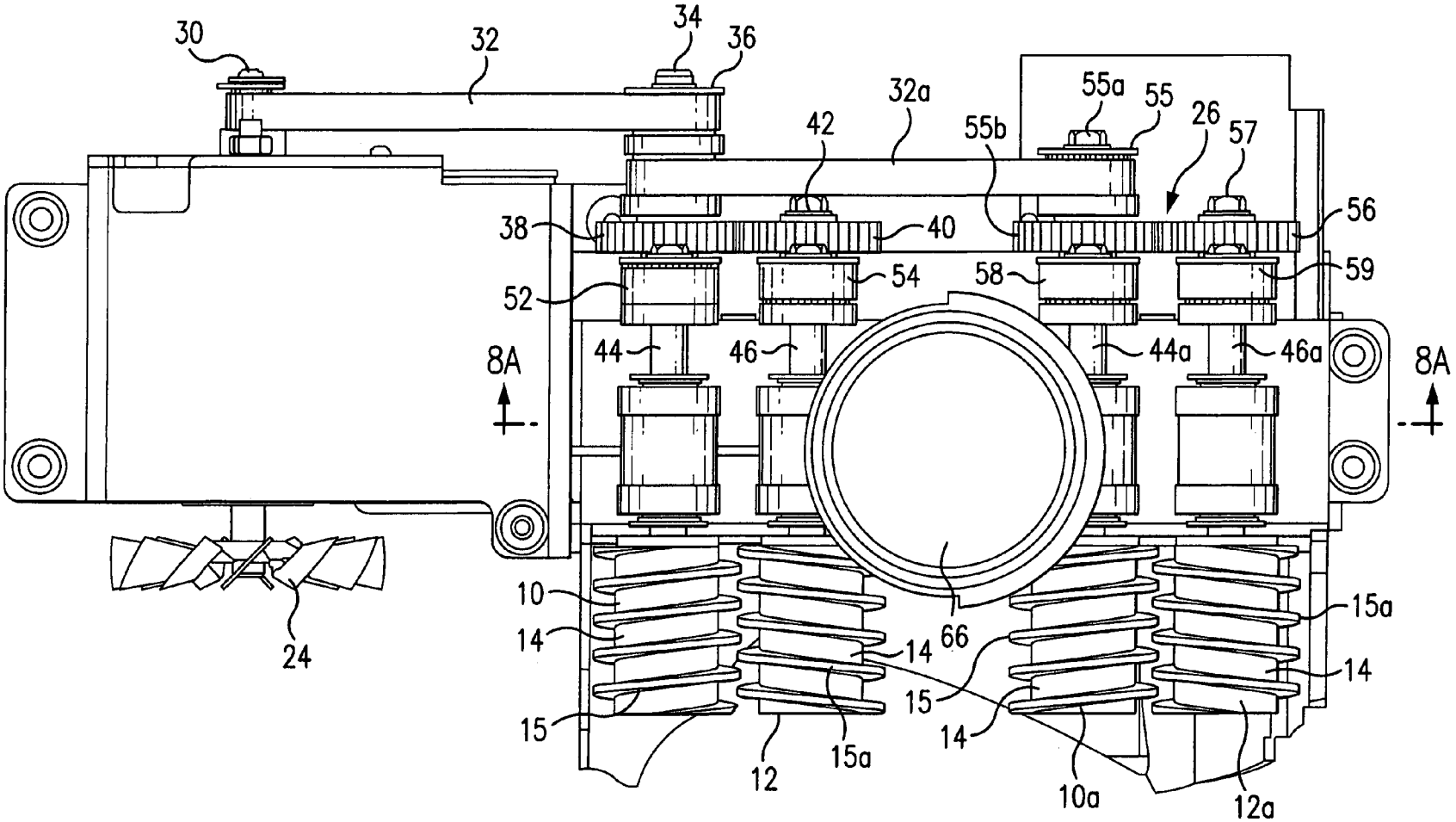
FIG. 5 is a top view, with the housing of FIG. 1 removed, showing the gear box and grinding wheels of the electric sharpener of FIG. 1.

Referring now to FIGS. 1-13, there is illustrated the electric sharpener of the invention, generally designated by reference numeral 2. The sharpener 2 has a hollow housing 4 made of metal or plastic and the like (not shown). The top 4*a* of housing 4 includes a pair of spaced open sharpening slots 6*a*, 6*b*. Two pairs of counter-rotating abrasive wheels 10, 12 and 10*a*, 12*a* are respectively exposed in slots 6*a* and 6*b* for sharpening operations. Each of the pairs of wheels 10, 12 and 10*a* and 12*a* have exterior surfaces coated with a diamond other abrasive material. The slots 6*a*, 6*b* functions as sharpening slots in which a knife or other blade is inserted for sharpening. As best seen in FIG. 5, the pairs of abrasive wheels 10, 12, and 10*a*, 12*a* each have a central hub 14 upon which integral helical ridges 15 having abrasive surfaces and in the form of continuous threads are present. The ridges 15 and 15*a* overlap a portion of each other, whereby, for example, ridges 15 form right handed threads and ridges 15*a* form left handed threads. An abrasive material is affixed to outer peripheral and side surfaces of the ridges 15, 15*a*. Enhanced sharpening also is provided by the invention because the abrasive wheels 10, 12 rotate upward such that both sides of the blade edge in each slot are sharpened at the same time. The spacing between abrasive wheels 10, 12 is selected to be different than the spacing between abrasive wheels 10*a*,12*a*, such that the wheels 10,12 and 10*a*, 12*a* in each slot 6*a*,6*b* can provide a different sharpening angle as desired at all adjusted positions as will be described later.

As seen in FIGS. 5, 6, 7 and 9, an electric motor 22 having fan 24 is mounted on frames within housing 4 to be driven by an external voltage source (not shown) or alternatively by a rechargeable battery in a conventional manner. The electric motor 22 is suitably an economical, low torque electric motor, such as a single phase induction motor. One type of an AC single phase motor is known as a shaded-pole motor of conventional design. A power drive assembly 26 supported by internal frame members couples the output shaft 22*a* of electric motor 22 to the two pairs of counter-rotating abrasive wheels 10, 12 and 10*a*, 12*b* and is capable of stepping down the rotation output of the electric motor 22, such that a significant torque is simultaneously generated to the two sets abrasive wheels 10, 12 and 10*a*, 12*a* for effective sharpening.

The rearward extending output shaft 22*a* has an output pulley 30 (FIGS. 4 and 5) that drives a continuous looped belt 32 of conventional design. The belt 32 rotates lower rotatable mounted shaft 34 through pulley 36. A pinion gear 38 is mounted on shaft 34 and rotates meshing pinion gear 40 affixed to parallel shaft 42 in the opposite direction. The abrasive wheels 10, 12 are mounted in affixed manner to the opposite ends of shafts 44 and 46 journalled above shafts 34, 42. The shafts 44 and 46 are driven by continuous belts 52 and 54 respectively coupled to upper pulleys 48, 50 and lower pulleys (not shown) on shafts 34, 42. The second pair of abrasive wheels 10*a*, 12*a* are affixed to opposite ends of shafts 44*a* and 46*a*. A continuous drive belt 32*a* is driven by a pulley 36*a* (FIG. 9) which belt is also coupled to pulley 55 affixed to lower shaft 55*a*. A pinion gear 55*b* is mounted on shaft 52*a* and intermeshes with pinion gear 56 which is affixed to shaft 57 for rotation in the opposite direction. A pair of belts 58, 59 respectively couple shafts 55*a* and 57 with shafts 44*a* and 46*a* to drive wheels 10*a* and 12*a* in opposite directions in a similar manner as abrasive wheels 10, 12 are driven.

Figure 6:
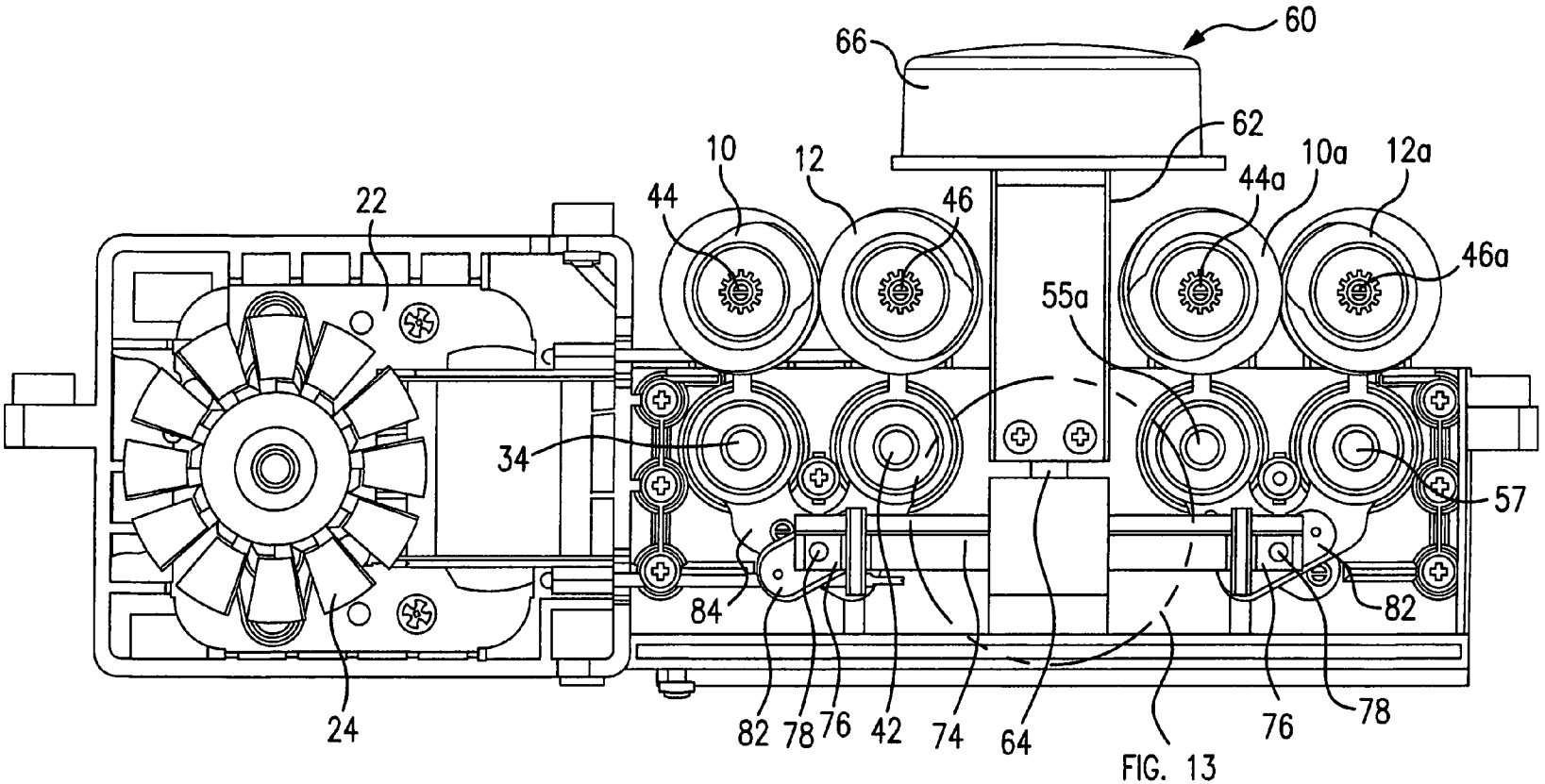
FIG. 6 is a front elevational view, with the housing of FIG. 1 removed, showing the gear box and grinding wheels of the electric sharpener of FIG. 1.
Figure 7:
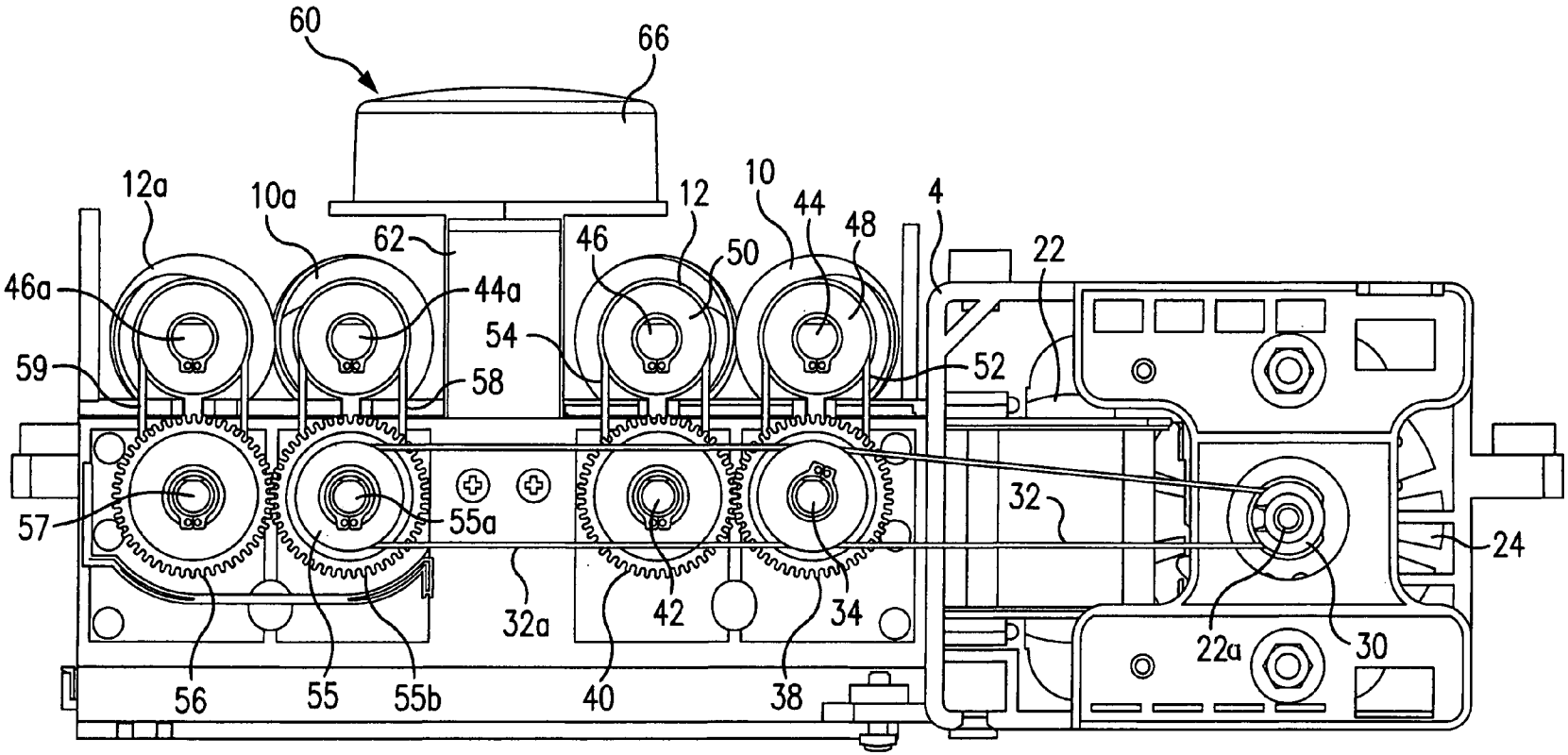
FIG. 7 is a rear elevational view, with the housing of FIG. 1 removed, showing the gear box and grinding wheels of the electric sharpener of FIG. 1.
Figure 8:
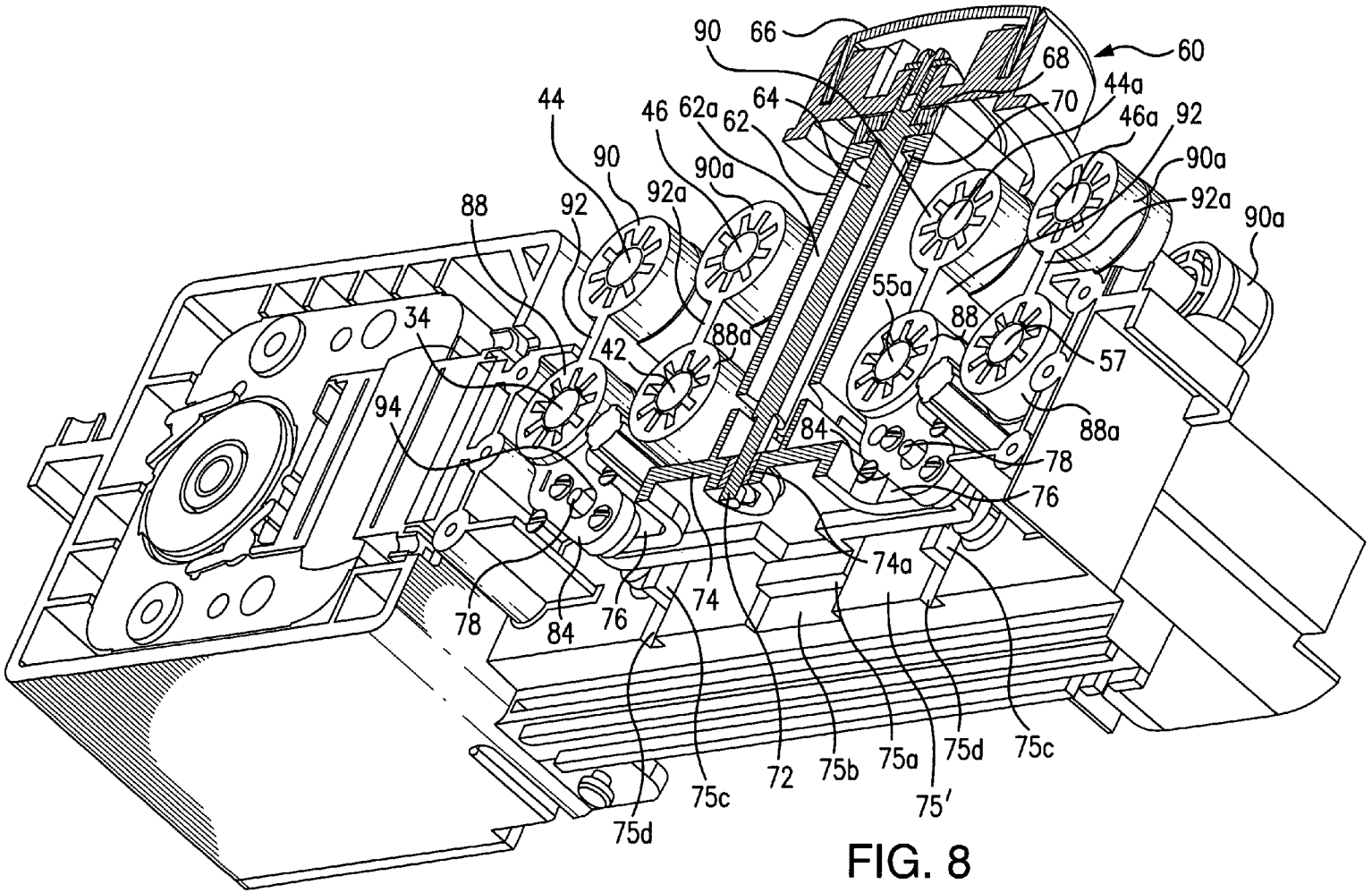
FIG. 8 is a front perspective view, with parts in section, of the translation bar of the adjustment assembly, with one of each of the two pairs of adjustment arms removed, of the electric sharpener of FIG. 1.
Figure 8A:
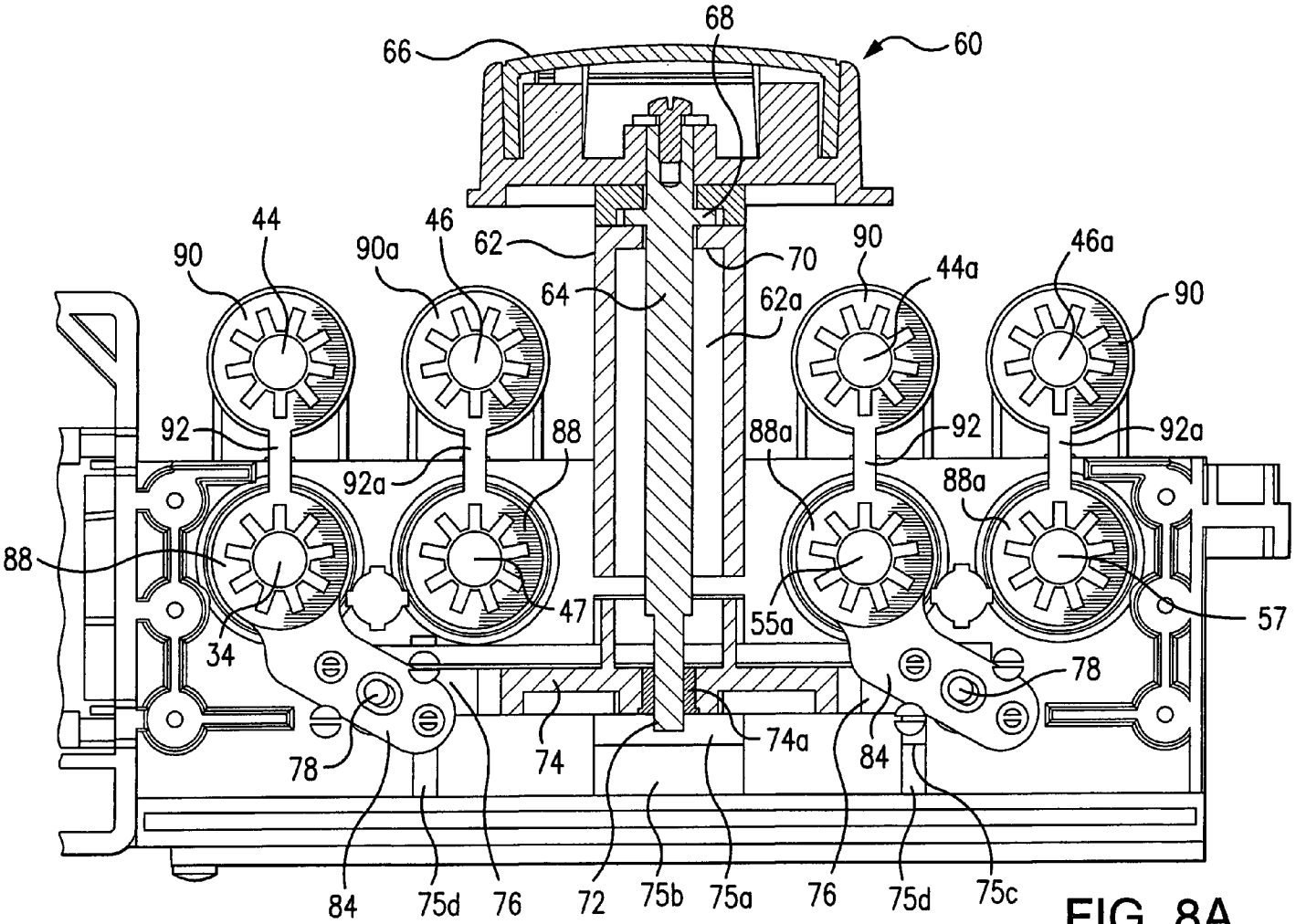
FIG. 8*a* is a front sectional view taken along lines 8A-8A of FIG. 5, of the electric sharpener of FIG. 1.
Figure 9:
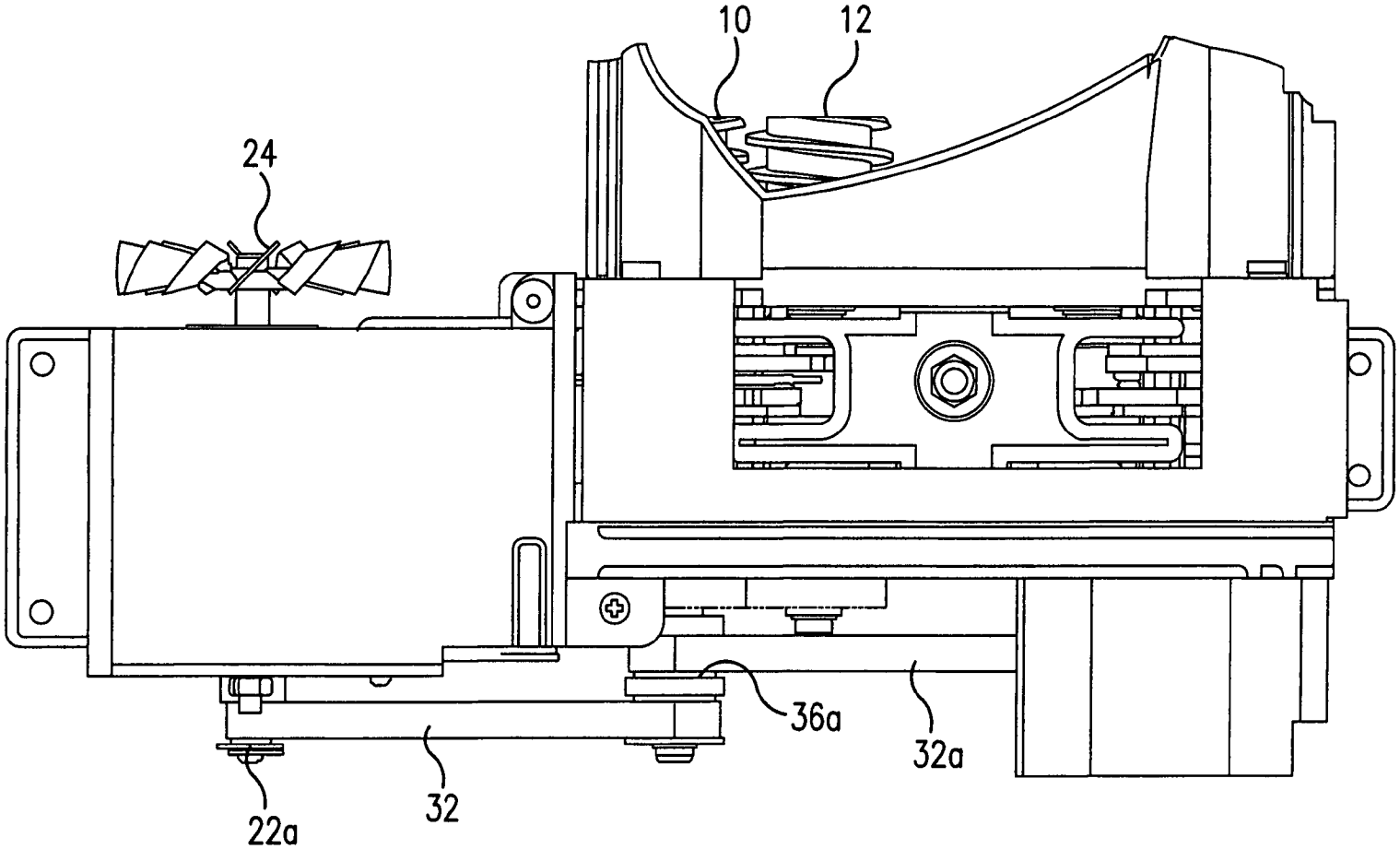
FIG. 9 is a bottom plan view, with parts broken away, of the electric sharpener of FIG. 1.
Figure 10:
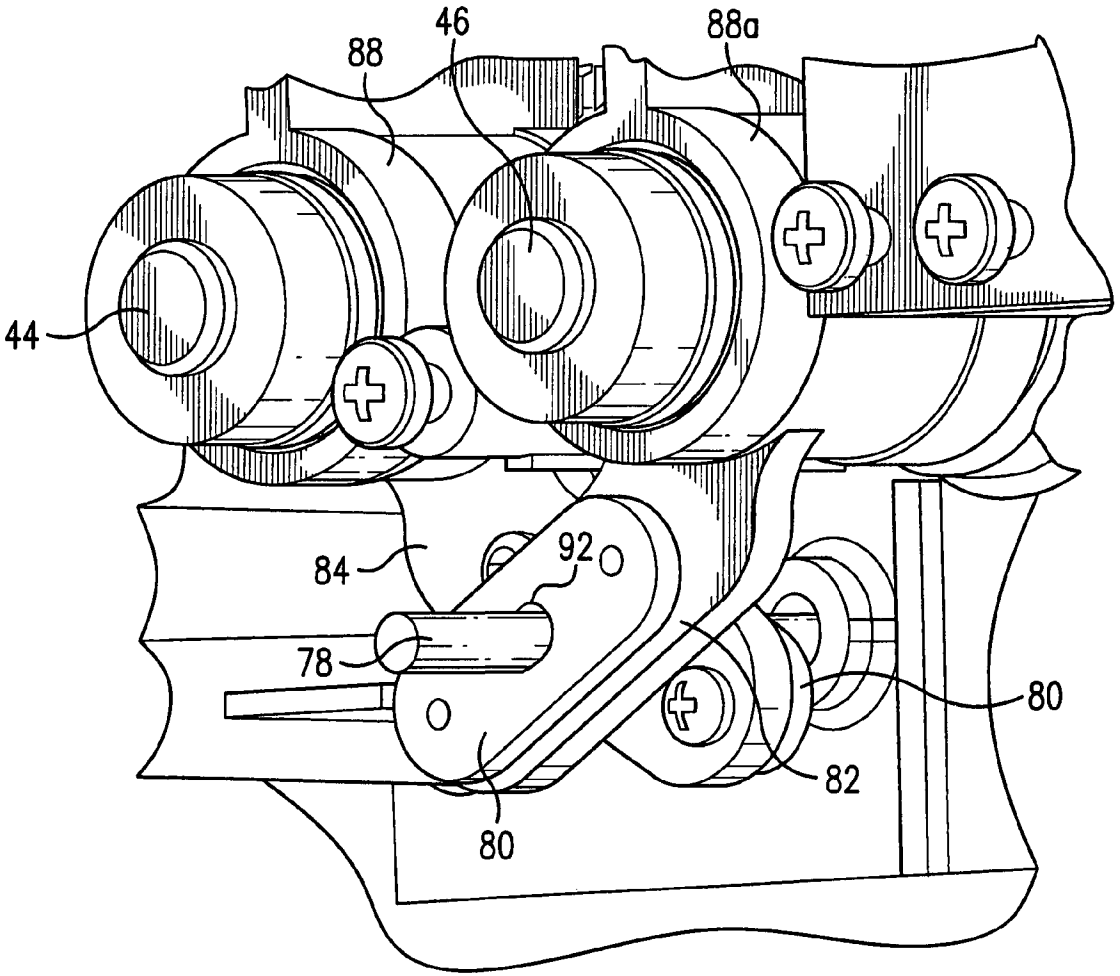
FIG. 10 is a partial front perspective view, with parts removed, of the translation bar of the adjustment assembly of the electric sharpener of FIG. 1.
Figure 11:
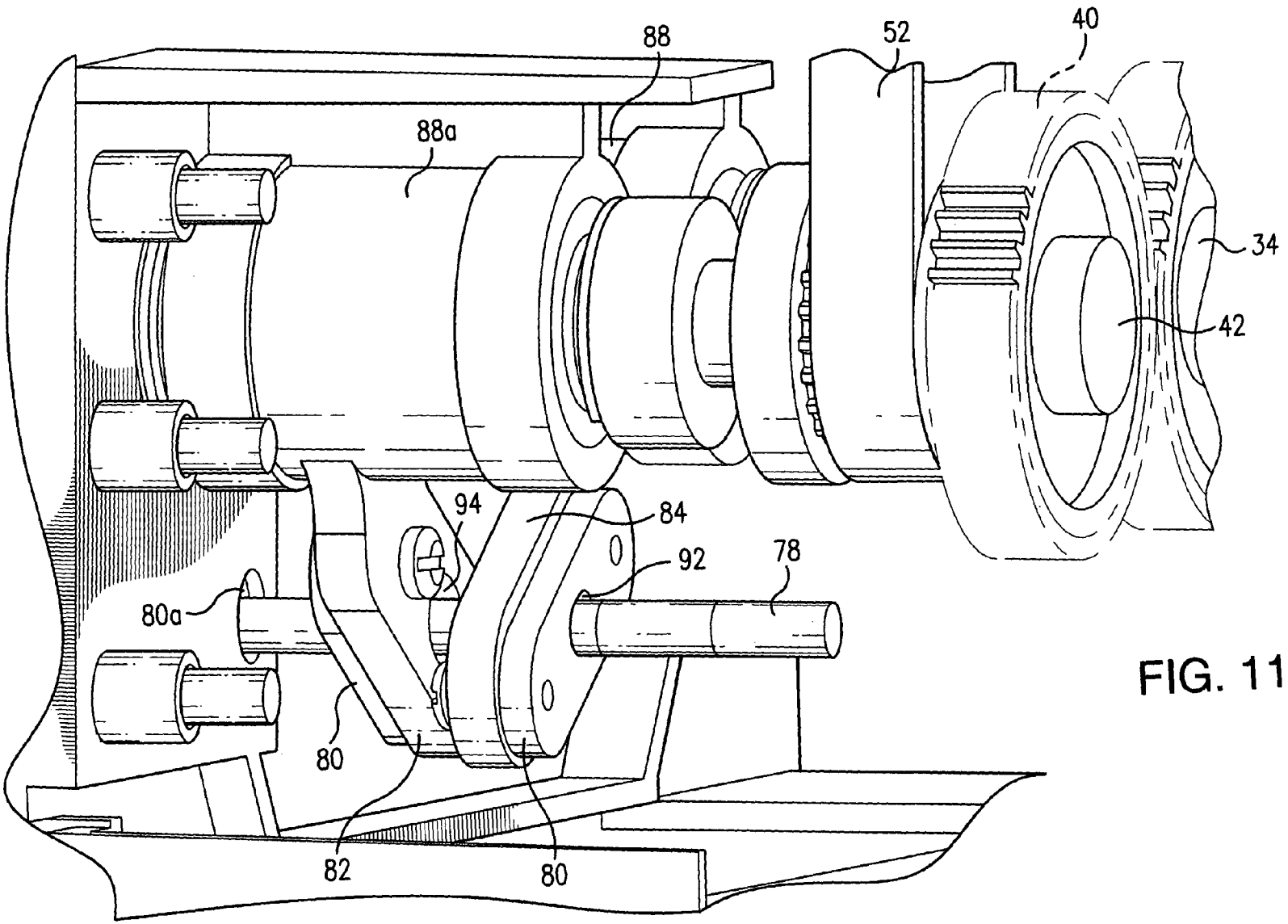
FIG. 11 is a partial side perspective view, with parts removed, of the translation bar of the adjustment assembly of the electric sharpener of FIG. 1.
Figure 12:
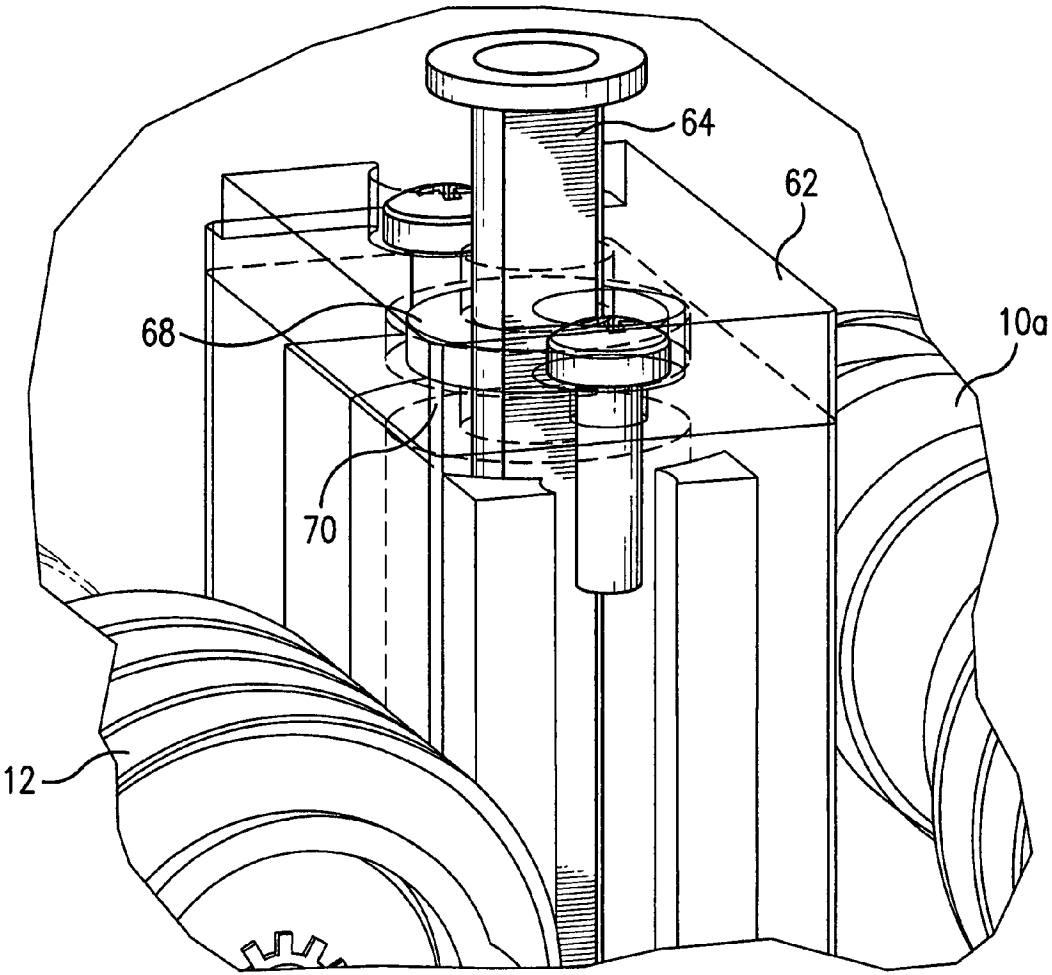
FIG. 12 is a partial front perspective view, with parts removed, of the adjustment assembly of the electric sharpener of FIG. 1.
Figure 13:
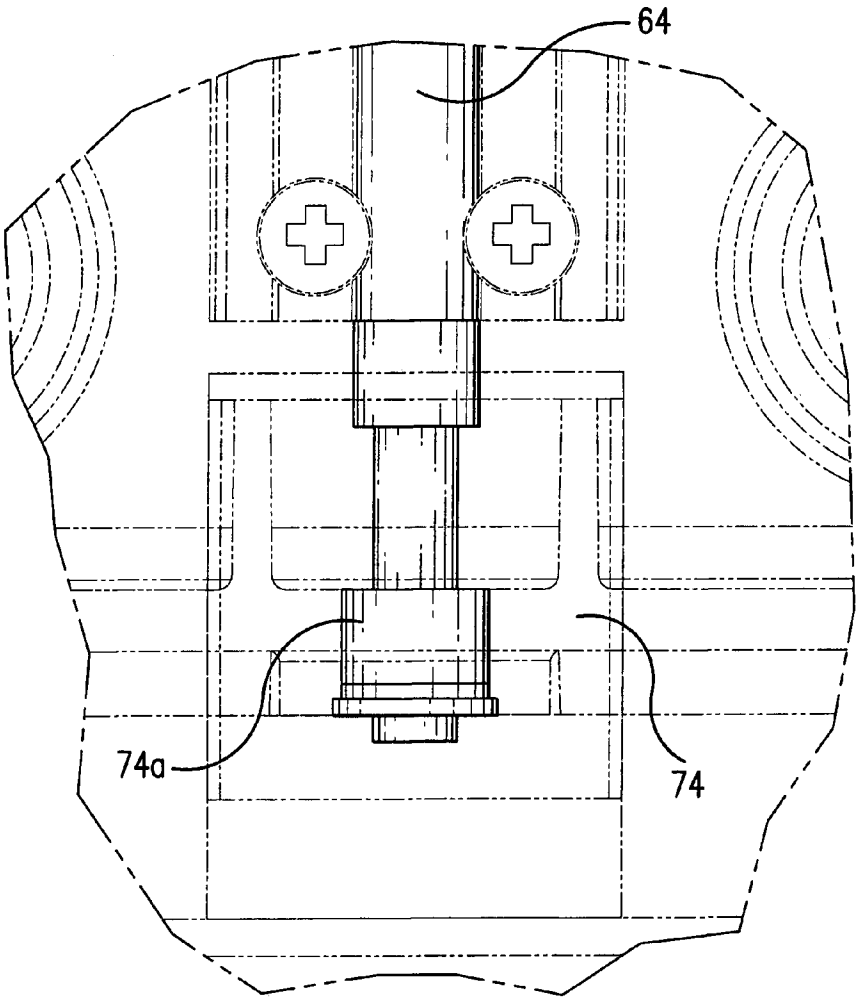
FIG. 13 is partial front elevational view, with parts removed, of the treaded bottom end portion of the adjustment shaft of FIG. 8.

Referring to FIGS. 6, 7, 8, 8*a* and 10-13, adjustment assembly 60 for adjusting the sharpening angle of the counter rotating abrasive wheel assemblies 10 and 12 is illustrated. The adjustment assembly 60 acts to selectively move the grinding wheels 10 and 12, and 10*a* and 12*a* toward and away from each other in a manner that varies the sharpening angle of the blades being sharpened to accommodate different sizes of blades and to select desired angles. The adjustment assembly 60 includes a vertically arranged adjustment housing 62 suitably mounted within housing 4 and having an hollow interior 62*a* receiving a vertical shaft 64 (FIGS. 8, 8*a*). The vertical shaft 64 is rotatably mounted within hollow interior 62*a* and is rigidly connected at its upper end to an exterior knob 66 which can be selectively rotated to rotate shaft 64. The upper portion of shaft 64 is formed with a widened flange 68 which contacts shoulder 70 during rotation to prevent shaft 64 from moving axially along its axis of rotation. The lower portion 72 of shaft 64 is treaded and extends through a hole in a moveable platen 74. The hole in platen 74 includes a threaded insert 74*a* such that rotation of shaft 64 causes platen 74 to move upward and downward dependent on the direction of rotation of shaft 64. As best shown in FIGS. 8 and 8*a*, a guide tab 75*a* is integrally attached to platen 74 and maintains flat vertical movement by being confined in slot 75*b* formed in a vertical wall 75' in housing 4. For further guidance of the platen, outer guide tabs 75*c* are maintained in slots 75*d* in wall 75'. As seen in FIGS. 6, 8, and 8*a*, moveable platen 74 has peripheral wings 76 through which a translation bar 78 extends. The translation bar 78 extends through angularly arranged elongated guide inserts 80 which are respectively affixed to a pair of angularly oriented adjustment arms 82, 84 (FIGS. 10 and 11), and through an elongated guide hole 80*a* (FIG. 11).

As seen in FIGS. 8 and 8*a* the lower shafts 34, 42 are respectively mounted for rotation in side by side bushings 88 and lower shaft 55*a* and 57 are mounted in side by side bushings 88*a*. The upper shafts 44, 46 respectively carrying abrasive wheels 10, 12, and upper shafts 44*a* and 46*a* respectively carrying abrasive wheels 10*a*, 12*a* are mounted for rotation in adjacent bushings 90, 90*a*. The bushings 90 and 90*a* on each side of adjustment housing 62 are respectively interconnected to lower bushings 88, 88*a* by connecting members 92 and 92*a* to move as a unit during adjustment. The bushings herein described for each pair of upper and lower shafts are mounted in a well-known manner to permit limited rotational movement, such as by slotted holes. As seen in FIGS. 10 and 11 adjustment arm 82 is integrally attached to bushing 88*a*, and adjustment arm 84 is integrally attached to bushing 88 on both sides of adjustment housing 62 viewing FIG. 8*a*. The translation bars 78 which are respectively coupled to the two pairs of lower bushings 88,88*a* extend through guide bar holes 92, adjustment arms 82, 84 and guide hole 80*a*.

In making adjustments rotation of shaft 64 through knob 66 causes the platen 74 to move vertical upward or downward dependent on the direction of rotation of shaft 64. This motion is simultaneously transferred to both translation bars 78 which are coupled to two respective pairs of lower shaft bushings 88, 88*a* The movement of the translation bars 78 in a vertical direction is simultaneously transmitted to both adjustment arms connected to each pair of abrasive wheels, through the slotted mounting so that the lower and upper bushings moving as a unit undergo rotational movement and simultaneously adjust each pair abrasive wheels 10, 12 and 10*a* and 12*a* toward and away from each other to alter the sharpening angle. The sharpening angle of abrasive wheels 10, 12 is initially set to be different than the initial sharpening angle of abrasive wheels 10*a*, 12*a* so that the pairs of abrasive wheels simultaneously provide different sharpening angles in all adjustment position. The slots which allow the translation bars 78 to undergo relative motion to rotate the adjustment arms provide limited travel which is capable of providing the entire angle adjustment of the wheels as needed in sharpening operations.

What is claimed is:

1. An adjustable electric sharpener for sharpening the edge of a blade to selected angles comprising:

a housing rotatably mounting a pair of interlocking abrasive wheels in side by side relationship, said pair of abrasive wheels being mounted for movement toward and away from each to adjust the sharpening angle of the edge being sharpened, an adjustment assembly being operatively connected to each of said pair of abrasive wheels, said adjustable assembly having a rotatable element connected to a moveable platen, said moveable platen being moved in response to rotation of said rotatable element and;

a translation bar connected to said moveable platen for movement therewith and to said pair of abrasive wheels for simultaneously moving each of said pair of abrasive wheels toward and away from each other upon in response to rotation of said rotatable element to adjust the sharpening angle of the pair of an abrasive wheels.

2. The electric sharpener of claim 1 wherein said adjustment assembly further includes a pair of adjustment arms coupling movement of said translation bar to each of said pair of abrasive wheels.

3. The electric sharpener of claim 2 wherein said rotatable element is a rotatable shaft having a threaded end portion engaging said platen and causing said platen and said translation bar to undergo vertical movement for adjusting the sharpening angle produced by said pair of abrasive wheels.

4. The electric sharpener of claim 3 wherein said rotatable shaft includes a flange for preventing movement along the axis of rotation of the shaft.

5. The electric sharpener of claim 3 wherein two pairs of said interlocking abrasive wheels are rotatably mounted on said housing, each of two pairs of abrasive wheels being arranged to sharpen the edge of a blade, said adjustment assembly being operably connected to each of said two pairs of abrasive wheels for simultaneously moving each of said first pair of abrasive wheels toward and away from each other for adjusting the sharpening angle and for simultaneously moving each of said second pair of abrasive wheels toward and away from each other for adjusting the sharpening angle.

6. The electric sharpener of claim 5 wherein said first pair of abrasive wheels is set to produce a different sharpening angle on said blade than said second pair of abrasive wheels at all adjustment positions.

7. The electric sharpener of claim 6 wherein a pair of translation bars are operably connected to said platen and to a respective one of said two pairs of abrasive wheels.

8. The electric sharpener of claim 7 wherein said platen and said pair of translation bars undergo vertical movement in response to rotation of said rotatable shaft.

9. The electric sharpener of claim 8 wherein said adjustment assembly includes two pairs of adjustment arms, each pair respectively coupling the movement of one of said translation bars to one of said two pairs of abrasive wheels.

10. The electric sharpener of claim 7, wherein said pair of translation bars are retained on peripheral portions of said platen.

* * * * *